US009337546B2

(12) United States Patent
Watanabe et al.

(10) Patent No.: US 9,337,546 B2
(45) Date of Patent: May 10, 2016

(54) WAVEGUIDE SLOT ARRAY ANTENNA DEVICE

(71) Applicants: Hikaru Watanabe, Tokyo (JP); Satoshi Yamaguchi, Tokyo (JP); Toru Takahashi, Tokyo (JP); Narihiro Nakamoto, Tokyo (JP)

(72) Inventors: Hikaru Watanabe, Tokyo (JP); Satoshi Yamaguchi, Tokyo (JP); Toru Takahashi, Tokyo (JP); Narihiro Nakamoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 65 days.

(21) Appl. No.: 14/377,797

(22) PCT Filed: Jan. 30, 2013

(86) PCT No.: PCT/JP2013/052064
§ 371 (c)(1),
(2) Date: Aug. 8, 2014

(87) PCT Pub. No.: WO2013/145842
PCT Pub. Date: Oct. 3, 2013

(65) Prior Publication Data

US 2016/0028164 A1 Jan. 28, 2016

(30) Foreign Application Priority Data

Mar. 29, 2012 (JP) ..... 2012-077186
Oct. 4, 2012 (JP) ..... 2012-222157

(51) Int. Cl.
*H01Q 13/10* (2006.01)
*H01Q 21/00* (2006.01)

(52) U.S. Cl.
CPC ..... *H01Q 21/005* (2013.01)

(58) Field of Classification Search
CPC ..... H01Q 13/20; H01Q 21/0043
USPC ..... 343/771
See application file for complete search history.

(56) References Cited

U.S. PATENT DOCUMENTS 3,696,433 A 10/1972 Killion et al.

FOREIGN PATENT DOCUMENTS

| | | | |
|---|---|---|---|
| JP | S48-043852 | A | 6/1973 |
| JP | S52-007790 | Y1 | 2/1977 |
| JP | 2000-036711 | A | 2/2000 |

OTHER PUBLICATIONS

International Search Report; PCT/JP2013/052064; Apr. 23, 2013.
Johnson, Richard C.; Antenna Engineering Handbook Third Edition; McGrawHill; 1993; pp. 9-5 and 9-6.

*Primary Examiner* — Graham Smith
(74) *Attorney, Agent, or Firm* — Studebaker & Brackett PC

(57) ABSTRACT

A part of bent end sections of a slot is configured to overlap with a waveguide inner wall when seen from the normal direction of a narrow wall surface of a waveguide at which the slot is provided. Thus, the conductance of a single slot can be reduced by adjusting the joined amount of a tip section of the slot and the inner wall of the waveguide. As a result, even in the case where the number of slots provided per waveguide is increased while a waveguide width is restricted to be short with respect to a slot length, impedance matching with a waveguide bonding section can be taken.

15 Claims, 23 Drawing Sheets

WAVEGUIDE SLOT ARRAY ANTENNA DEVICE

TECHNICAL FIELD

The present invention relates to a waveguide slot array antenna device having a slot at at least one wall surface of a waveguide.

BACKGROUND ART

In a waveguide slot array antenna device in which a plurality of slots are formed at a wall surface of a waveguide with a rectangular sectional shape, a waveguide slot array antenna device in which a slot length is approximately ½ the wavelength, and which the slots are arranged at an interval of approximately ½ the guide wavelength (wavelength in waveguide) in a guide axis direction of the waveguide is publicly known.

FIG. 42 is a top view showing a waveguide slot array antenna device of Conventional Example 1.

In FIG. 42, a waveguide 1 has a short-circuit surface 2 at an end section and power is fed from the other side.

A guide axis direction of the waveguide 1 is defined as an x-direction, a direction orthogonal to a guide axis of the waveguide 1 on a wall surface at which a slot 100 is formed is defined as a y-direction, and a normal direction of the wall surface at which the slot 100 is formed is defined as a z-direction.

A waveguide inner wall 3 and a waveguide outer wall 4 respectively show the internal surface of a broad wall surface of the waveguide 1 and the external surface of the broad wall surface of the waveguide 1.

For convenience's sake, a dimension between the waveguide inner walls in the y-direction is denoted as b, and a dimension between the waveguide outer walls is denoted as B.

A narrow wall surface 5 is a wall surface at which the slot 100 is formed.

Respective slots 101 and 102 provided to the narrow wall surface 5 of the waveguide 1 are each inclined by an angle of $+\tau$ or $-\tau$ with respect to the y-direction orthogonal to the guide axis of the waveguide 1. Adjacent slots are each disposed to be symmetrical with respect to a center line 6 in a waveguide width direction between the adjacent slots.

On this occasion, a dimension of the slot 100 in the y-direction is smaller than the dimension b between the waveguide inner walls.

Impedance is matched by setting the whole length of the slot to be approximately ½ the wavelength to cause resonance for pure resistance and arranging the slot 100 with an inclination by the angle $\tau$ as the angle of arrangement for the slot 100 with respect to the y-direction orthogonal to the guide axis of the waveguide 1 to adjust the resistance of the slot 100.

In addition, since an electric field is generated in a width direction of the slot 100, linear polarization with polarization in the guide axis direction as the main polarization is radiated by disposing the respective adjacent slots to be symmetrical with respect to the center line 6 (see Non-Patent Document 1 below).

In the case where the frequency is constant and the dimension B between waveguide outer walls and the dimension b between waveguide inner walls in the y-direction of the waveguide 1 are reduced in the waveguide slot array antenna device of Conventional Example 1, the length of the slot 100 necessary to obtain resonance characteristics is unchanged at approximately ½ the wavelength, and only the dimension B between waveguide outer walls and the dimension b between waveguide inner walls in the y-direction of the waveguide 1 are reduced.

Therefore, in FIG. 42, the dimension of the slot 100 in the y-direction becomes larger than the dimension B between waveguide outer walls in the y-direction of the waveguide 1, the slot 100 protrudes beyond the edge of the waveguide inner wall 3, and a slot length necessary to obtain the resonance characteristics cannot be ensured.

Meanwhile, a method is proposed to ensure the resonance length of a slot such that the slot does not exceed the dimension b between waveguide inner walls by using a crank-shaped slot that is bent in the guide axis direction at both end sections of the slot when the waveguide width is smaller with respect to the slot length.

FIG. 43 is a top view showing a waveguide slot array antenna device of Conventional Example 2.

In FIG. 43, a crank-shaped slot 200 is formed on a wall surface of a coaxial line 201. Those similar to the above are denoted by the same reference numerals, and descriptions thereof will be omitted.

On this occasion, the configuration is such that a dimension of the crank-shaped slot 200 in the y-direction does not exceed a dimension b between waveguide inner walls (see Patent Document 1 below).

Although it is mentioned that the crank-shaped slot 200 is a configuration at the wall surface of the coaxial line 201 described above for resonating the slot 200 in a slot array antenna formed with the crank-shaped slot 200, a method of impedance adjustment for the slot 200 is neither disclosed nor implied.

Particularly, when the crank-shaped slot 200 is used in a waveguide slot array antenna, states of a current flowing in the wall surface of the coaxial line 201 and the waveguide wall surface are different, and an operation of the slots 200 is different accordingly.

Particularly in the case where the crank-shaped slot 200 is applied to a waveguide slot array antenna provided with the slot 100 at the narrow wall surface 5 of the waveguide 1 as shown in FIG. 42, a bent end section of the slot 200 is lengthened in the case where the slot length desired to obtain resonance with respect to the waveguide width is sufficiently long.

Due to this, the bent end section largely blocks a current flowing in the direction y orthogonal to the guide axis of the waveguide 1, thus increasing conductance per single slot.

Thus, in the case where it is necessary to increase the number of slots provided per waveguide, impedance cannot be matched with a waveguide bonding section.

In addition, assuming that the polarization in the guide axis direction is the main polarization, the cross polarization component of a radiation pattern of a single slot increases due to an increase in the electric field component orthogonal to the main polarization generated from the bent end section.

PRIOR ART DOCUMENTS

Patent Documents

Patent Document 1: U.S. Pat. No. 3,696,433

Non-Patent Document 1: RICHARD C. JOHNSON, ANTENNA ENGINEERING HANDBOOK THIRD EDITION, McGrawHill, 1993, pp. 9-5 to 9-6

SUMMARY OF THE INVENTION

Problems to be Solved by the Invention

Since the conventional waveguide slot array antenna device is configured as described above, the conductance per single slot increases due to the bent end section of the crank-shaped slot 200 largely blocking the current flowing in the direction y orthogonal to the guide axis of the waveguide 1.

Thus, in the case where it is necessary to increase the number of slots provided per waveguide, there has been a problem that impedance cannot be matched with the waveguide bonding section.

In addition, assuming that the polarization in the guide axis direction is the main polarization, there has been a problem that the cross polarization component of the radiation pattern of the single slot increases due to the increase in the electric field component orthogonal to the main polarization generated from the bent end section.

The present invention has been made to solve the problems described above, and an object of the invention is to obtain a waveguide slot array antenna device with a small cross polarization component and capable of impedance matching even in the case where the number of slots provided per waveguide is increased while the waveguide width is restricted to be short with respect to the slot length.

Means for Solving the Problems

In a waveguide slot array antenna device of the invention, when a direction orthogonal to a guide axis at a surface of a waveguide at which a slot is provided is denoted as a waveguide width direction, a middle section of the slot is placed in the waveguide width direction, and at least one of tip sections of the slot has a shape extending along a guide axis direction of the waveguide, and a part of the tip section of the slot extending along the guide axis direction is configured to overlap with an inner wall of the waveguide when seen from a normal direction of the surface of the waveguide at which the slot is provided.

Effect of the Invention

According to the invention, the part of the tip section of the slot extending along the guide axis direction is configured to overlap with the inner wall of the waveguide.

Thus, the conductance of the single slot can be reduced by adjusting the joined amount of the tip section of the slot and the inner wall of the waveguide.

Thus, even in the case where the number of slots provided per waveguide is increased while the waveguide width is restricted to be short with respect to the slot length, impedance matching with a waveguide bonding section can be taken.

In addition, it can be necessarily configured such that the middle section of the slot is long and that the tip section extending along the guide axis direction is short.

Thus, regarding components forming a radiation pattern, there is an advantageous effect such that cross polarization component thereof can be reduced, because contribution of an electric field generated at the middle section of the slot is larger, while contribution of an electric field generated at the tip section of the slot is smaller.

BEST MODE FOR CARRYING OUT THE INVENTION

In the following, in order to describe the present invention in more detail, embodiments for carrying out the invention will be described with reference to the accompanying drawings.

Embodiment 1

Figure 1:
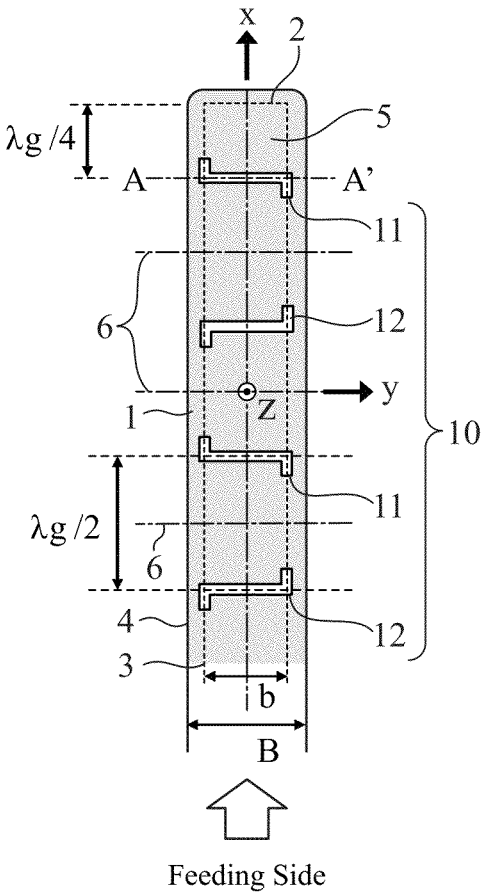
FIG. 1 is a top view showing a waveguide slot array antenna device according to Embodiment 1 of the present invention.

FIG. 1 is a top view showing a waveguide slot array antenna device according to Embodiment 1.

Figure 2:
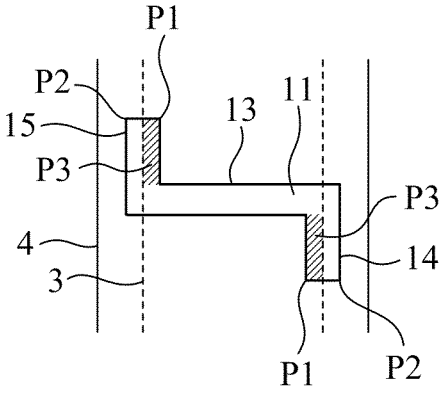
FIG. 2 is an enlarged view showing a single slot in FIG. 1.
Figure 3:
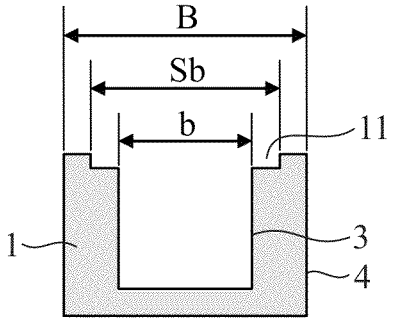
FIG. 3 is a cross sectional view showing an A-A' cross section in FIG. 1.

FIG. 2 is an enlarged view showing a single slot in FIG. 1, and FIG. 3 is a cross sectional view showing an A-A' cross section in FIG. 1.

In FIG. 1, a waveguide 1 with a rectangular sectional shape has a short-circuit surface 2 at an end section, and power is fed from the other side.

A guide axis direction of the waveguide 1 is defined as an x-direction, a direction orthogonal to a guide axis of the waveguide 1 on a wall surface at which a slot 10 is formed is defined as a y-direction, and a normal direction of the wall surface at which the slot 10 is formed is defined as a z-direction.

A waveguide inner wall 3 and a waveguide outer wall 4 respectively show an internal surface of a broad wall surface of the waveguide 1 and an external surface of the broad wall surface of the waveguide 1.

For convenience's sake, the dimension between waveguide inner walls in the y-direction is denoted as b, and the dimension between waveguide outer walls is denoted as B.

A narrow wall surface 5 is the wall surface at which the slot 10 is formed.

In FIG. 2, a middle section 13 of a slot 11 provided to the narrow wall surface 5 of the waveguide 1 extends in the y-direction orthogonal to the guide axis of the waveguide 1, and bent end sections 14 and 15 at both ends of the middle section 13 extend parallel to the guide axis direction of the waveguide 1.

The slot 11 has a crank shape in which the angle between the middle section 13 and the bent end section 14 or 15 at a tip section thereof is a right angle.

The whole length of the slot 11 is approximately ½ a wavelength thereof.

When the inner side of the bent end sections 14 and 15 of the slot 11 is denoted as P1 and the outer side thereof is denoted as P2, the inner side P1 exists on the inner side in the waveguide 1 relative to the waveguide inner wall 3, and the outer side P2 exists on the outer side in the waveguide 1 relative to the waveguide inner wall 3.

Note that a shaded section is a portion of the bent end sections 14 and 15 that penetrates into the waveguide when the slot 11 is seen from above and is a joining section P3 between the slot 11 and the interior of the waveguide 1.

When the dimension of the slot 11 in the y-direction is denoted as Sb in FIG. 3, the dimension Sb is set between the dimension b between waveguide inner walls and the dimension B between waveguide outer walls.

That is, the slot 11 is configured to overlap with the inner wall 3 of the waveguide 1 when the slot 11 is seen from above.

In FIG. 1, a plurality of the slots 10 are arranged at an interval of approximately ½ the guide wavelength in length in the guide axis direction of the waveguide 1, and arranged upside down to be symmetrical with respect to a center line 6 orthogonal to the guide axis direction.

Next, an operation thereof will be described.

Since a high-frequency signal input to the waveguide 1 propagates in TE10 mode, a current flows in the y direction orthogonal to the guide axis in the narrow wall surface 5 of the waveguide 1.

The waveguide 1 is short-circuited, and the current becomes maximum at a location apart from the short-circuit surface 2 by approximately ¼ the guide wavelength. The slot 11 is arranged in that position.

By arranging a plurality of slots 11 and 12 at an interval of approximately ½ the guide wavelength from the position of the slot 11, the respective slots 11 and 12 are provided to block the maximum current flowing in the narrow wall surface 5.

Since the length of the slot 10 is approximately ½ the wavelength, the high-frequency signal propagated through the waveguide 1 joins with each of the plurality of slots 10, whereby the slots 10 are resonated.

On this occasion, the waveguide slot array antenna device is represented by an equivalent circuit in which the loads of the slots 10 are constituted in a parallel circuit.

Figure 4:
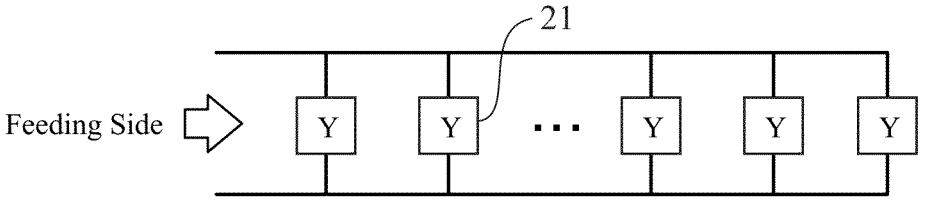
FIG. 4 is a circuit diagram showing an equivalent circuit of the waveguide slot array antenna device.

FIG. 4 represents an equivalent circuit of the waveguide slot array antenna device, and 21 denotes an admittance (Y=G+jB (G: the conductance and B: the susceptance)) of the single slot.

In this case, since each slot 10 has a resonance length, the susceptance component of an admittance 21 of the single slot is zero.

Therefore, assuming that the number of the slots 10 within the waveguide is N (N is an arbitrary natural number), the admittance where the short-circuit surface is seen from the feeding side is N times the real part of the admittance 21 of each slot, namely the conductance.

Thus, in order to match a characteristics admittance of the waveguide 1 with a load admittance where the short-circuit surface is seen from the feeding side, when the characteristics admittance of the waveguide 1 is normalized to 1, a desired conductance per slot becomes 1/N.

When each slot 10 satisfies this condition, a radio wave is radiated efficiently from each slot 10.

Next, an effect thereof will be described.

In FIG. 2, the shaded section in the bent end sections 14 and 15 is the joining section P3 between the slot 11 and the interior of the waveguide 1.

Regarding a method of arranging the slot, as a portion parallel to the guide axis direction of the slot is larger, the current is largely blocked, and thus the conductance of the slot is larger, Therefore, with a configuration in which a part of the slot 11 is protruded from the waveguide inner wall 3, adjustment of the joined amount of the bent end sections 14 and 15 of the slot 11 and the interior of the waveguide 1 is carried out, whereby the conductance of the single slot can be reduced.

In this manner, the number of slots provided per waveguide can be increased.

Further, moving both end sections of the slot 11 toward the outer side in the waveguide 1 naturally enables a configuration in which the middle section 13 of the slot 11 is long and the bent end sections 14 and 15 are short.

Therefore, regarding components forming a radiation pattern, it is possible to reduce the cross polarization level, since contribution of an electric field generated at the middle section 13 of the slot 11 is large and contribution of an electric field generated at the bent end sections 14 and 15 of the slot 11 is small.

Figure 5:
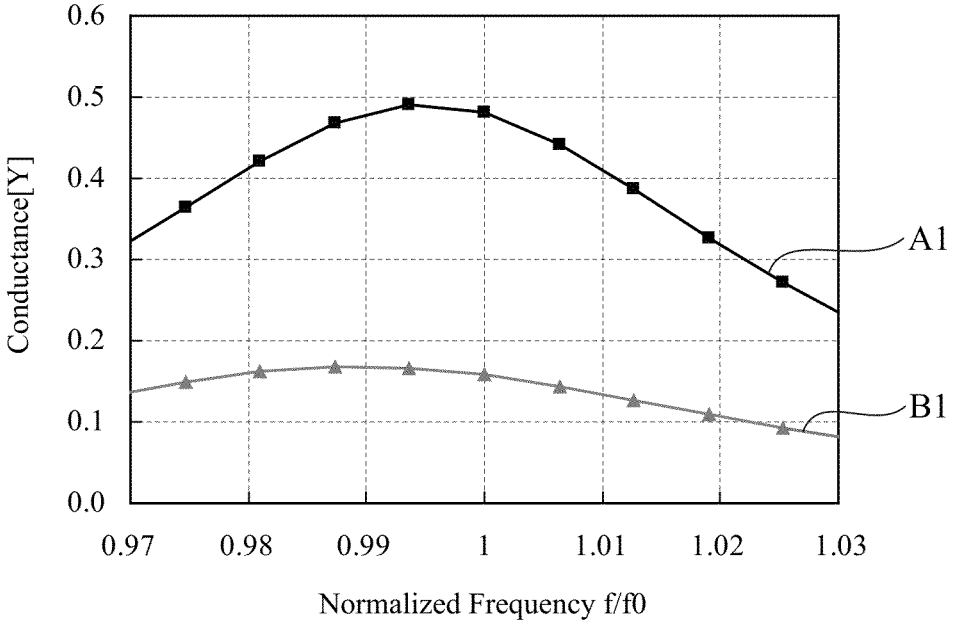
FIG. 5 is a characteristic diagram showing normalized frequency versus conductance characteristics.
Figure 43:
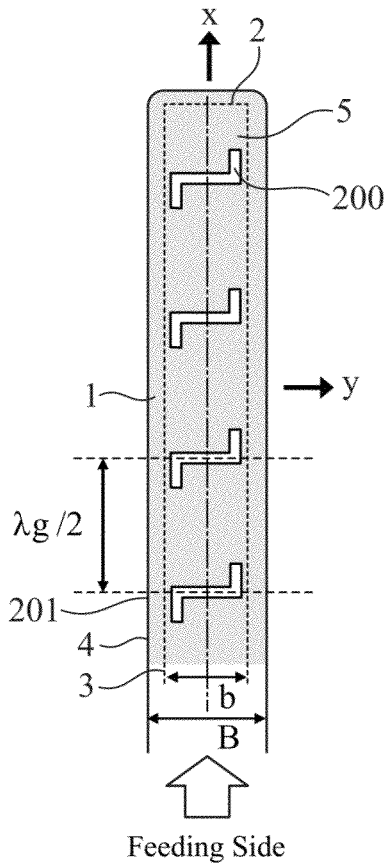
FIG. 43 is a top view showing a waveguide slot array antenna device of Conventional Example 2.

As one example of a low conductance effect according to Embodiment 1, FIG. 5 shows compared calculation results of conductance values in a single slot element, in a case where the crank-shaped slot 200 of Conventional Example 2 shown in FIG. 43 is provided to the narrow wall surface 5 of the waveguide 1 and in a case where the slot 10 according to Embodiment 1 shown in FIG. 1 is provided thereto.

Note that the whole length of the slot is adjusted such that resonance characteristics are obtained at a center frequency (f/f0=1) for each slot.

In FIG. 5, an abscissa represents a frequency normalized with a resonant frequency, and an ordinate represents a real part of an admittance normalized with the characteristics admittance of a waveguide, namely a normalized conductance value.

In addition, A1 is the characteristics of the slot 200 of Conventional Example 2, and B1 is the characteristics of the slot 10 of Embodiment 1.

From FIG. 5, the normalized conductance value at the center frequency (f/f0=1) takes a value of 0.48 in the case of the slot 200 of Conventional Example 2, and 0.16 in the case of the slot 10 of Embodiment 1. It can be confirmed that the conductance value is reduced to ⅓ in the characteristics B1 of the slot 10 of Embodiment 1 with respect to the characteristics A1 of the slot 200 of Conventional Example 2.

Figure 6:
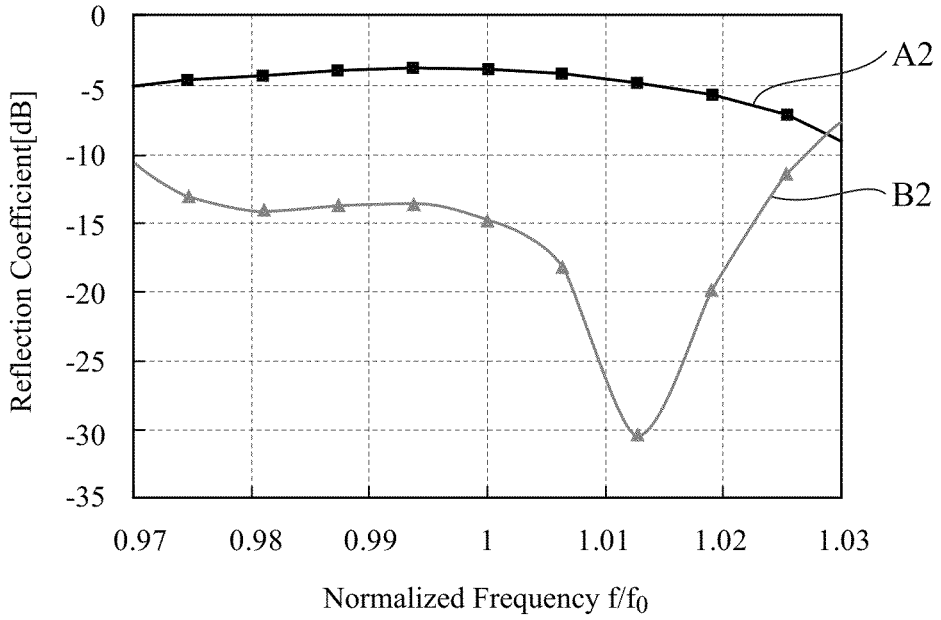
FIG. 6 is a characteristic diagram showing normalized frequency versus return loss characteristics.

FIG. 6 shows frequency characteristics in reflection coefficient in the case where the slot 200 of Conventional Example 2 and the slot 10 of Embodiment 1 compared in FIG. 5 each are applied to an array antenna of which the number N of slots per waveguide is six.

In FIG. 6, the reflection coefficient at the center frequency (f/f0=1) is −14.75 dB for the characteristics B2 in the slot 10 of Embodiment 1 in contrast to −3.82 dB for the characteristics A2 in the slot 200 of Conventional Example 2. It can be confirmed that the reflection coefficient is improved by 10.93 dB.

In this manner, since the reduction in conductance of the single slot is achieved with the use of Embodiment 1, it is possible to obtain the low reflection coefficient even in the case where the number N of slots is increased.

Figure 7:
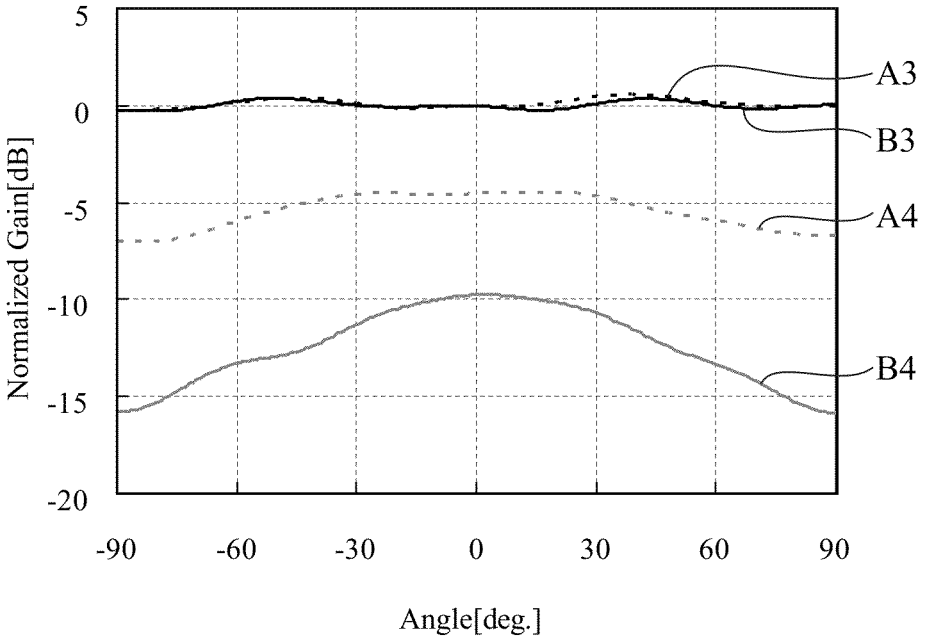
FIG. 7 is a characteristic diagram showing angle versus normalized frequency characteristics.

In a similar manner to the above, FIG. 7 shows calculation results of radiation patterns in a single slot element as one example of a cross polarization level reduction effect.

In FIG. 7, an abscissa represents an angle, and an ordinate represents a gain normalized with a value of gain in a front direction of an antenna (angle=0°).

In addition, broken lines of A3 and A4 are the characteristics of the slot 200 of Conventional Example 2, and solid lines of B3 and B4 are the characteristics of the slot 10 of Embodiment 1; A3 and B3 represent main polarizations, and A4 and B4 represent cross polarizations.

In FIG. 7, a cross polarization level with respect to the main polarization in the front direction of the antenna is −4.51 dB for the slot 200 of Conventional Example 2 and −9.76 dB for the slot 10 of Embodiment 1. Embodiment 1 allows the cross polarization level to be reduced by 5.25 dB.

These are one example of the calculations. By changing the amount of the joining section P3 between the interior of the waveguide 1 and the bent end sections 14 and 15 of the slot 11 shown in FIG. 2, adjustment of the conductance or the cross polarization level becomes further possible.

As described above, according to Embodiment 1, the middle section 13 of the slot 11 is configured to protrude from the inner wall 3, and the joining section P3 between the slot 11 and the interior of the waveguide 1 is provided in the bent end sections 14 and 15 of the slot 11.

Therefore, the conductance of the single slot can be reduced by adjusting the joined amount of the bent end sections 14 and 15 of the slot 11 and the interior of the waveguide 1.

Thus, even in the case where the number of slots provided per waveguide is increased while the waveguide width is restricted to be short with respect to the slot length, impedance matching with a waveguide bonding section can be taken.

Moreover, it can be necessarily configured such that the middle section 13 of the slot 11 is long and that the bent end sections 14 and 15 extending along the guide axis direction is short.

Thus, regarding the components forming the radiation pattern, the cross polarization component can be reduced, since the contribution of the electric field generated at the middle section 13 of the slot 11 is large and the contribution of the electric field generated at the bent end sections 14 and 15 of the slot 11 is small.

Embodiment 2

Figure 8:
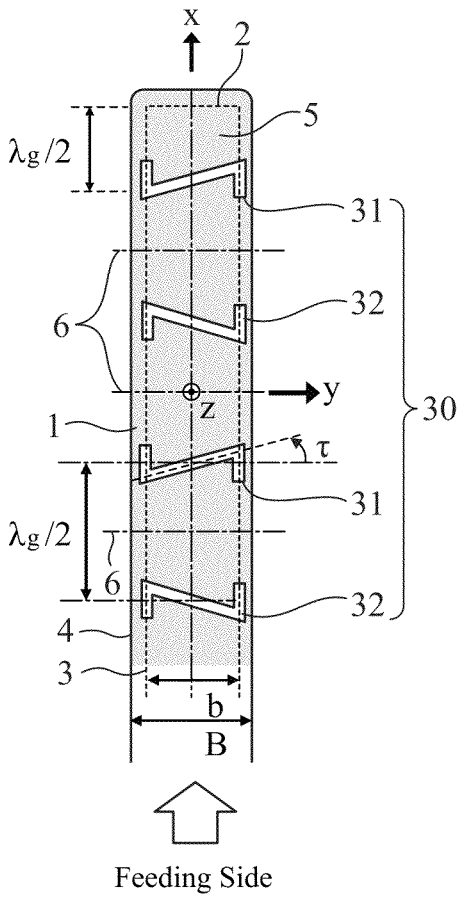
FIG. 8 is a top view showing a waveguide slot array antenna device according to Embodiment 2 of the invention.

FIG. 8 is a top view showing a waveguide slot array antenna device according to Embodiment 2.

Figure 9:
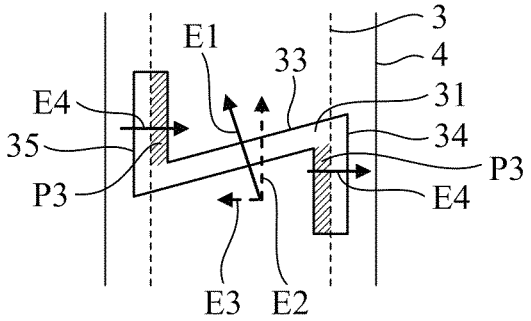
FIG. 9 is an enlarged view showing a single slot in FIG. 8.

FIG. 9 is an enlarged view showing a single slot in FIG. 8.

In the figure, a slot 30 is formed in a Z-shape at a narrow wall surface 5 of a waveguide 1.

A middle section 33 of a slot 31 provided to the narrow wall surface 5 of the waveguide 1 is placed to be inclined by an angle τ with respect to the y-direction orthogonal to a guide axis of the waveguide 1, and bent end sections 34 and 35 at both ends of the middle section 33 extend parallel to a guide axis direction of the waveguide 1.

The slot 31 has a Z-shape in which an angle between the middle section 33 and the bent end section 34 or 35 at a tip section thereof is an acute angle.

The whole length of the slot 31 is approximately ½ the wavelength.

A shaded section is a portion of the bent end sections 34 and 35 that penetrates into the waveguide when the slot 31 is seen from above and is a joining section P3 between the slot 31 and the interior of the waveguide 1.

An electric field E1 of the middle section 33 of the slot 31 is generated in a width direction of the slot 31 and is decomposed into an electric field E2 and an electric field E3 as components respectively in the x-direction and y-direction. Also, E4 is an electric field of the bent end sections 34 and 35 of the slot. Those similar to the above are denoted by the same reference numerals, and descriptions thereof will be omitted.

Next, an operation thereof will be described.

First, a conductance thereof will be described.

Since a degree of blockage of a current by the slot 31 can be also adjusted by changing the angle τ of the middle section 33 of the slot 31, it is possible to further adjust the conductance.

Thus, even in the case where the number of slots provided per waveguide is increased, impedance matching with a waveguide bonding section can be taken.

Next, a cross polarization thereof will be described.

Assuming that a polarization in the guide axis direction is a main polarization, the middle section 33 of the slot 31 is at the angle τ in order to achieve a desired conductance.

The electric field E1 generated from the middle section 33 of the slot 31 at this time is generated in the slot width direction.

Therefore, a cross polarization component is generated from the middle section 33 of the slot 31 depending on the angle τ of the middle section 33.

The electric field E1 generated at the middle section 33 of the slot 31 can be decomposed into and considered as the electric field E2 that is the guide axis component and the electric field E3 that is the component orthogonal to the guide axis.

On the other hand, from the bent end sections 34 and 35 of the slot 31, the electric field E4 is generated in a direction perpendicular to the guide axis.

Thus, by forming the slot 31 to be in a Z-shape, the electric field E3 that is the component in the waveguide width direction of the electric field E1 generated from the middle section 33 of the slot 31 and the electric field E4 generated from the bent end sections 34 and 35 of the slot 31 are synthesized to cancel out the cross polarization component. Therefore, it is possible to reduce the cross polarization component.

As described above, according to Embodiment 2, the middle section 33 of the slot 31 is placed to be inclined by the angle τ with respect to the y-direction orthogonal to the guide axis of the waveguide 1.

Therefore, in addition to the effect of Embodiment 1, it is possible to adjust further the conductance, since the degree of blockage of the current by the slot 31 can be also adjusted by changing the angle τ of the middle section 33 of the slot 31.

Thus, even in the case where the number of slots provided per waveguide is increased while the waveguide width is restricted to be short with respect to the slot length, impedance matching with a waveguide bonding section can be taken.

Moreover, by forming the slot 31 to be in a Z-shape, the electric field E3 that is the component in the waveguide width direction of the electric field E1 generated from the middle section 33 of the slot 31 and the electric field E4 generated from the bent end sections 34 and 35 of the slot 31 are synthesized to cancel out the cross polarization component. Therefore, the cross polarization component can be reduced.

Embodiment 3

Figure 10:
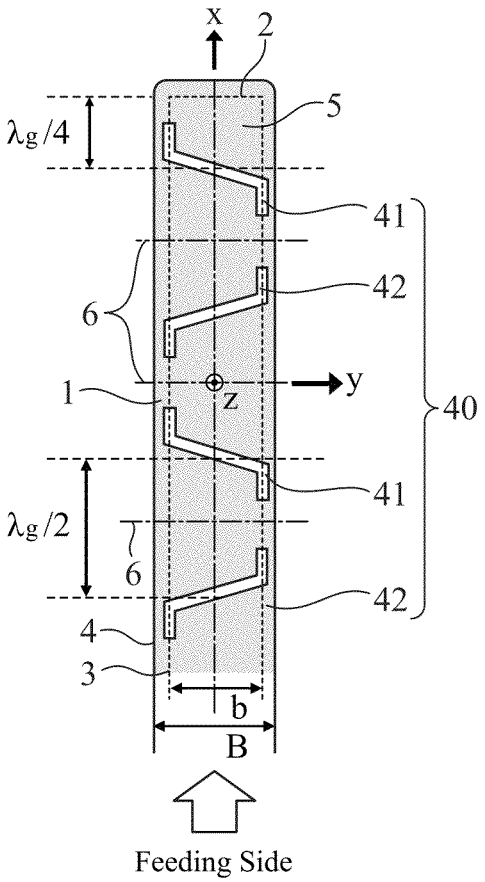
FIG. 10 is a top view showing a waveguide slot array antenna device according to Embodiment 3 of the invention.

FIG. 10 is a top view showing a waveguide slot array antenna device according to Embodiment 3.

In the figure, a slot 40 is formed in a crank shape at a narrow wall surface 5 of a waveguide 1.

Bent end sections at both ends of slots 41 and 42 are extended parallel to a guide axis direction of the waveguide 1.

An angle between the middle section of the slots 41 and 42 and the bent end section at a tip section thereof is formed to be an obtuse angle. Those similar to the above are denoted by the same reference numerals, and descriptions thereof will be omitted.

Figure 11:
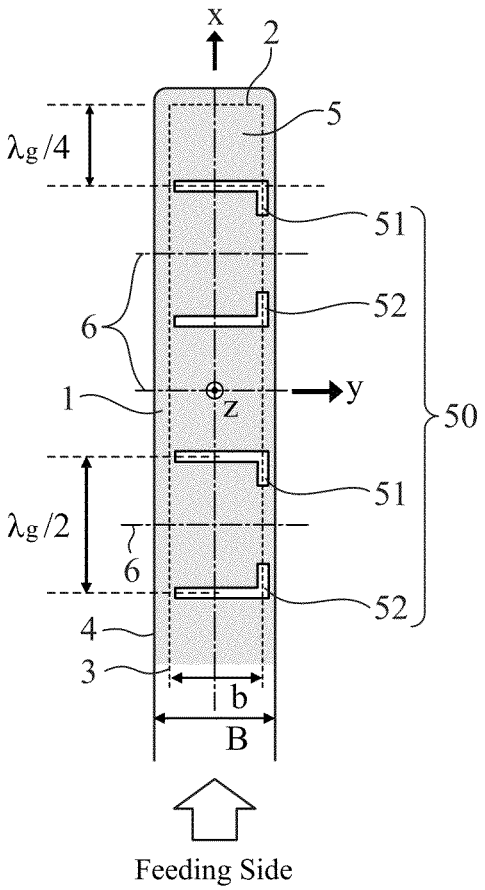
FIG. 11 is a top view showing another waveguide slot array antenna device according to Embodiment 3 of the invention.

FIG. 11 is a top view showing another waveguide slot array antenna device according to Embodiment 3.

In the figure, a slot 50 is formed in an L-shape at a narrow wall surface 5 of a waveguide 1.

A bent end section at one end of slots 51 and 52 extends parallel to a guide axis direction of the waveguide 1.

An angle between the middle section of the slots 51 and 52 and the bent end section at a tip section thereof is formed to be a right angle. Those similar to the above are denoted by the same reference numerals, and descriptions thereof will be omitted.

Figure 12:
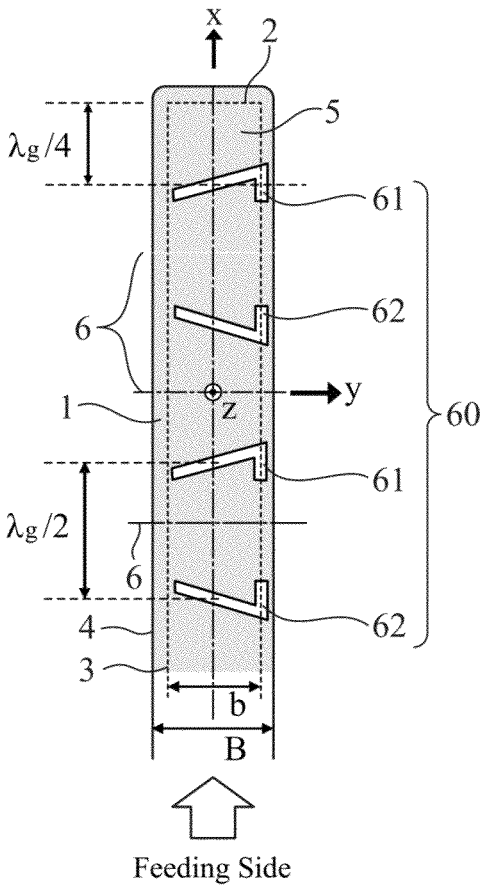
FIG. 12 is a top view showing another waveguide slot array antenna device according to Embodiment 3 of the invention.

FIG. 12 is a top view showing another waveguide slot array antenna device according to Embodiment 3.

In the figure, a slot 60 is formed in an L-shape at a narrow wall surface 5 of a waveguide 1.

A bent end section at one end of slots 61 and 62 extends parallel to a guide axis direction of the waveguide 1.

The angle between the middle section of the slots 61 and 62 and the bent end section at a tip section thereof is formed to be an acute angle. Those similar to the above are denoted by the same reference numerals, and descriptions thereof will be omitted.

Figure 13:
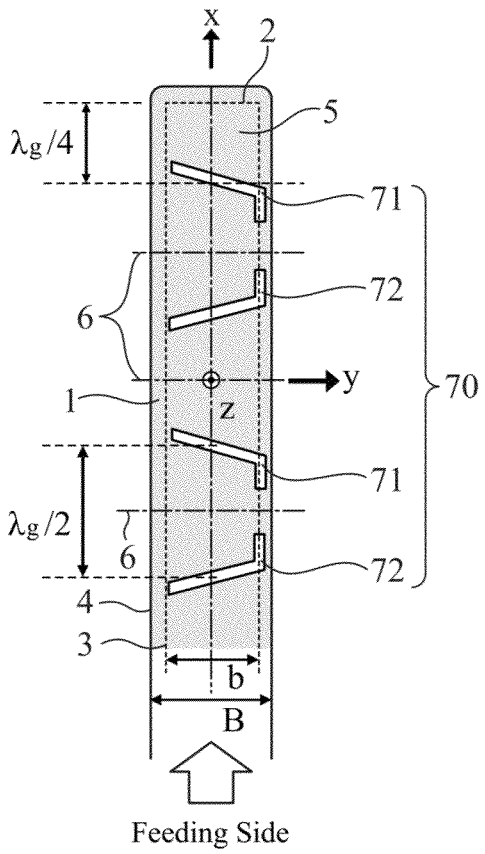
FIG. 13 is a top view showing another waveguide slot array antenna device according to Embodiment 3 of the invention.

FIG. 13 is a top view showing another waveguide slot array antenna device according to Embodiment 3.

In the figure, a slot 70 is formed in an L-shape at a narrow wall surface 5 of a waveguide 1.

A bent end section at one end of slots 71 and 72 extends parallel to a guide axis direction of the waveguide 1.

An angle between the middle section of the slots 71 and 72 and the bent end section at a tip section thereof is formed to be an obtuse angle. Those similar to the above are denoted by the same reference numerals, and descriptions thereof will be omitted.

Figure 14:
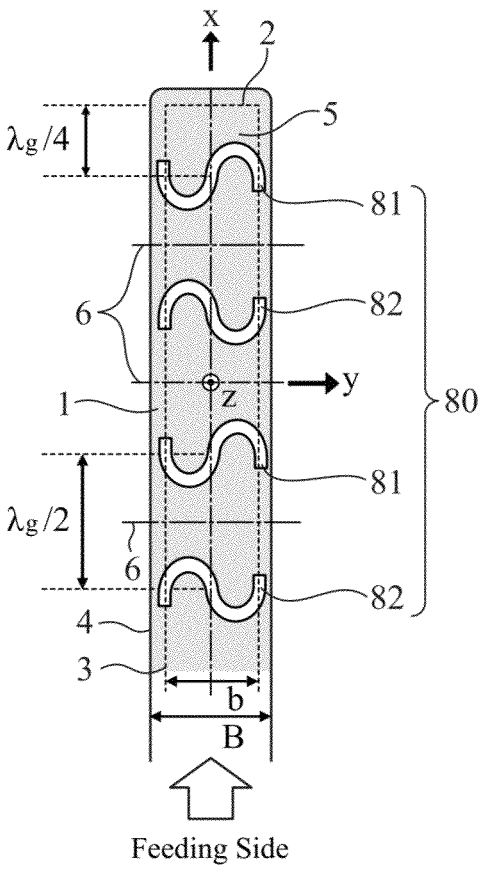
FIG. 14 is a top view showing another waveguide slot array antenna device according to Embodiment 3 of the invention.

FIG. 14 is a top view showing another waveguide slot array antenna device according to Embodiment 3.

In the figure, a slot 80 is formed in an S shape at a narrow wall surface 5 of a waveguide 1.

A middle section of slots 81 and 82 is curved, and bent end sections at both ends extend parallel to a guide axis direction of the waveguide 1. Those similar to the above are denoted by the same reference numerals, and descriptions thereof will be omitted.

The shapes of the slots have been shown in Embodiment 1 and Embodiment 2, not limited to these, and the shapes shown in FIG. 10 to FIG. 14 are also acceptable.

In addition, the slots shown in FIG. 10 to FIG. 13 have a shape of a bent line. However, it may have a shape formed of a curved line, as shown in FIG. 14.

Further, although the bent end sections at both ends of the slot are extended to only either of a plus x-direction and a minus x-direction in FIG. 10 to FIG. 14, the bent end section of the slot can also be configured to diverge in the two directions of the plus x-direction and the minus x-direction.

Figure 15:
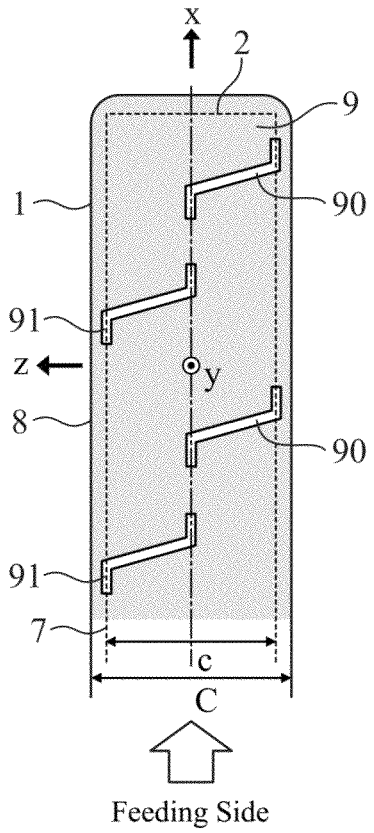
FIG. 15 is a top view showing another waveguide slot array antenna device according to Embodiment 3 of the invention.

FIG. 15 is a top view showing another waveguide slot array antenna device according to Embodiment 3.

In FIG. 15, a waveguide inner wall 7 and a waveguide outer wall 8 respectively show an internal surface of a narrow wall surface of a waveguide 1 and an external surface of the narrow wall surface of the waveguide 1.

For convenience' sake, a dimension between waveguide inner walls in a z-direction is denoted as c, and a dimension between waveguide outer walls is denoted as C.

A broad wall surface 9 is a wall surface at which slots 90 and 91 are formed.

The slots 90 and 91 are formed in a crank shape at the broad wall surface 9 of the waveguide 1.

Bent end sections at both ends of the slots 90 and 91 are extended parallel to a guide axis direction of the waveguide 1.

An angle between the middle section of the slots 90 and 91 and the bent end section at a tip section thereof is formed to be an obtuse angle.

The whole length of the slots 90 and 91 is approximately ½ the wavelength.

Note that the bent end section at one end of the slots 90 and 91 is configured to overlap with the inner wall 7 of the waveguide 1 when the slots 90 and 91 are seen from above. Those similar to the above are denoted by the same reference numerals, and descriptions thereof will be omitted.

Although the slot is placed at the narrow wall surface 5 of the waveguide 1 in Embodiment 1 and Embodiment 2, the slots 90 and 91 may be placed at the broad wall surface 9 of the waveguide 1, as shown in FIG. 15.

Moreover, the slot may be placed at both the narrow wall surface 5 and the broad wall surface 9 of the waveguide 1.

Figure 16:
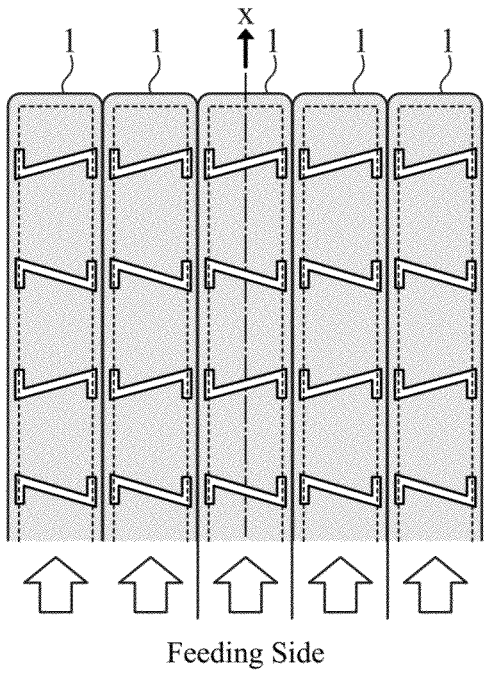
FIG. 16 is a top view showing another waveguide slot array antenna device according to Embodiment 3 of the invention.

FIG. 16 is a top view showing another waveguide slot array antenna device according to Embodiment 3.

In the figure, a waveguide slot array antenna shown in Embodiment 2 is used as one sub-array, and an array antenna is configured by arranging a plurality of the sub-arrays.

Those similar to the above are denoted by the same reference numerals, and descriptions thereof will be omitted.

Additionally, an array antenna may be configured by arranging a plurality of waveguide slot array antennas shown in Embodiment 1 and Embodiment 3 other than Embodiment 2.

Further, the following may be available: the waveguide 1 is a ridge waveguide provided with a ridge; the waveguide 1 is a coaxial waveguide that is a coaxial line; or the waveguide 1 is a dielectric-filled waveguide filled with dielectric in at least a part of the waveguide interior.

As described above, according to Embodiment 3, a degree of freedom in the design can be further provided through the modified examples of a variety of configurations, in addition to the configurations shown in Embodiment 1 and Embodiment 2.

Embodiment 4

Figure 17:
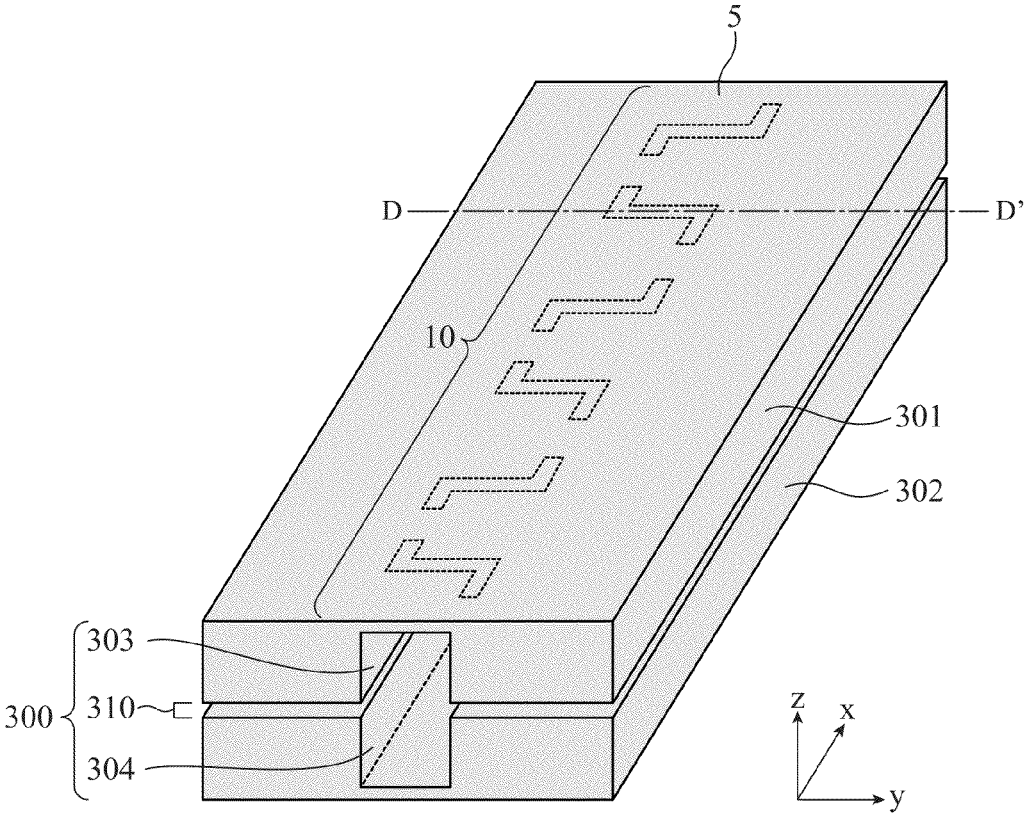
FIG. 17 is a top perspective view showing a waveguide slot array antenna device according to Embodiment 4 of the invention.

FIG. 17 is a top perspective view showing a waveguide slot array antenna device according to Embodiment 4.

In FIG. 17, a case where a slot 10 is provided to a narrow wall surface 5 of a waveguide as in Embodiment 1 is shown by way of example.

Figure 18:
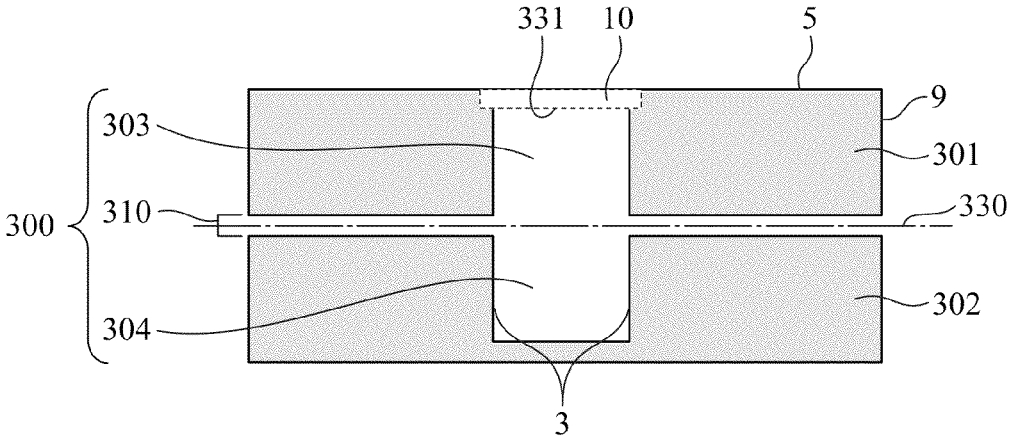
FIG. 18 is a cross sectional view showing a D-D' cross section in FIG. 17.

FIG. 18 is a cross sectional view showing a D-D' cross section in FIG. 17.

In the waveguide slot array antenna device according to this embodiment in FIG. 17, a recessed conductive member 301 provided with a rectangular groove 303 and a recessed conductive member 302 provided with a similarly rectangular groove 304 are opposed to thus form a waveguide 300 with an approximately rectangular cross section.

In FIG. 18, a dividing plane 330 of the waveguide 300 is approximately at a middle section of a broad wall surface 9 of the waveguide 300. At the dividing plane 330, there is provided with a gap 310 that is provided intentionally upon stacking the two recessed conductive members 301 and 302.

In addition, the slot 10 is provided to a bottom surface 331 of the rectangular groove 303.

Note that the waveguide 300 constituted of the two recessed conductive members 301 and 302 divided by the dividing plane 330 is fabricated by applying metal plating to a member molded through resin injection molding.

Next, an operation thereof will be described.

The dividing plane 330 of the waveguide 300 in this embodiment is at the middle section of the broad wall surface 9, and a high-frequency signal input to the waveguide is propagated in TE10 mode as shown in Embodiment 1.

On this occasion, no current occurs in the middle section of the broad wall surface 9 where there is the dividing plane 330.

Thus, in this embodiment, a current flowing in the waveguide inner wall 3 is not disrupted or separated at the dividing plane 330 of the waveguide 300.

In this manner, the high-frequency signal within the waveguide is propagated without leakage from the dividing plane 330, and the high-frequency signal joins with each of the plurality of slots 10. Therefore, an efficient waveguide slot array antenna device can be achieved.

By maintaining the predetermined gap 310 at the dividing plane 330 of the waveguide 300, contact friction that occurs at a contact section of the conductive members 301 and 302 can be prevented.

In this embodiment, the two recessed conductive members 301 and 302 are fabricated by applying metal plating to the member molded by resin injection molding.

Thus, by preventing the contact friction that occurs at the contact section of the two recessed conductive members 301 and 302, peeling of the metal plating can be prevented.

When the metal plating of the waveguide 300 is peeled, propagation characteristics thereof are deteriorated, which leads to deterioration in the antenna characteristics. Therefore, preventing this in advance enables a longer durability for the antenna.

Figure 19:
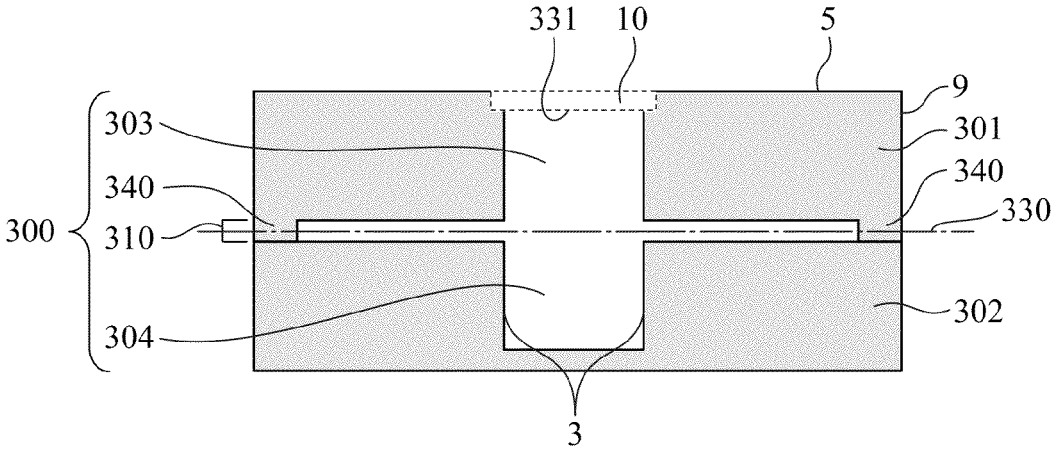
FIG. 19 is a cross sectional view showing another waveguide slot array antenna device according to Embodiment 4 of the invention.

FIG. 19 is a cross sectional view showing another waveguide slot array antenna device according to Embodiment 4.

In FIG. 19, a protruding section 340 is provided at a surface of the conductive member 301 opposing the conductive member 302.

In this manner, when stacking the two recessed conductive members 301 and 302, the protruding section 340 for mutual contact is provided in a position sufficiently apart from the waveguide inner wall 3, whereby the predetermined gap 310 can be maintained and fixed.

Note that in FIG. 19, the following form of the protruding section 340 may be available: a protrusion is provided to both of the conductive member 301 and the conductive member 302, or a protrusion is provided to only one of them.

Figure 20:
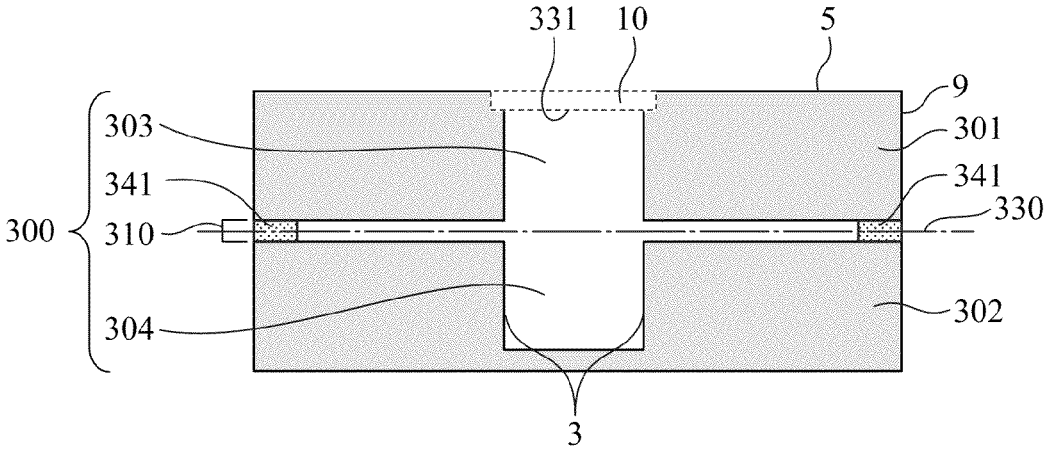
FIG. 20 is a cross sectional view showing another waveguide slot array antenna device according to Embodiment 4 of the invention.

FIG. 20 is a cross sectional view showing another waveguide slot array antenna device according to Embodiment 4.

In FIG. 20, a spacer 341 is provided to be sandwiched between opposing surfaces of the conductive member 301 and the conductive member 302.

The spacer 341 may be sandwiched in place of the protruding section 340 in this manner, and thus the predetermined gap 310 can be maintained and fixed in a similar manner.

It should be noted that no metal plating is applied to the protruding section 340 and the spacer 341 of the conductive members 301 and 302 serving as the contact sections. This is to prevent enlargement of a peeling place of the metal plating originating from a peeling portion of the metal plating due to friction.

Incidentally, in this embodiment, the description of the manufacturing method for the conductive members 301 and 302 forming the waveguide slot array antenna device has been limited to only the resin molding, not limited to this, and a manufacturing method such as cutting, die casting, or diffusion bonding of metal may be used for the waveguide, or any free combination of these is acceptable.

As described above, according to Embodiment 4, the recessed conductive member 301 provided with the rectangular groove 303 and the recessed conductive member 302 provided with the rectangular groove 304 are opposed with the gap 310 therebetween to thus form the waveguide 300 with an approximately rectangular cross section.

Therefore, the high-frequency signal within the waveguide is propagated without leakage from the dividing plane 330, and an efficient waveguide slot array antenna device can be achieved.

Moreover, even in the case where the conductive members 301 and 302 are formed of the resin on the surface of which the metal plating is applied, the peeling of the metal plating due to the contact friction can be prevented to thus prevent the deterioration in the antenna characteristics.

Embodiment 5

Figure 21:
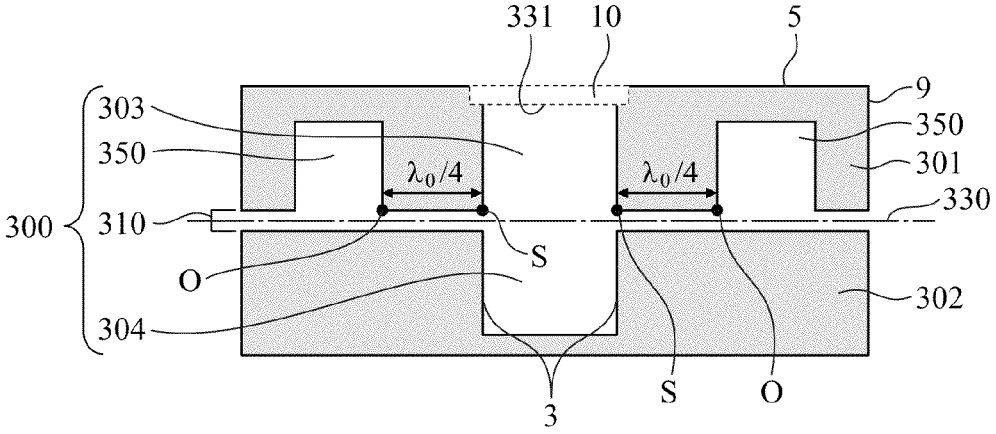
FIG. 21 is a cross sectional view showing a waveguide slot array antenna device according to Embodiment 5 of the invention.

FIG. 21 is a cross sectional view showing a waveguide slot array antenna device according to Embodiment 5.

In FIG. 21, the waveguide slot array antenna device according to this embodiment is provided with a groove 350 in a position apart from an inner wall 3 of a waveguide by an odd number multiple of approximately ¼ the free space wavelength at a usable frequency, in addition to the waveguide structure of Embodiment 4. Those similar to the above are denoted by the same reference numerals, and descriptions thereof will be omitted.

Next, an operation thereof will be described.

In the case of the rectangular waveguide of which the waveguide cross section is ideal in Embodiment 4 described above, division is made at approximately the middle section of the broad wall surface 9 where the current flowing within the waveguide becomes zero, and thus a waveguide slot array antenna device with good efficiency can be obtained without leakage of a high-frequency signal flowing within the waveguide from the dividing plane.

However, in the case where there is an asymmetric structure such as the slot 10 at the narrow wall surface 5 of the waveguide 300, there are cases where the middle section of the broad wall surface 9 of the waveguide 300 is not necessarily ideal for the dividing plane, in the case where the waveguide cross section has become an asymmetric structure with respect to the dividing plane 330 due to a draft angle, rounding (R), or the like at the time of the resin injection molding.

In addition, when a manufacturing error occurs in the depths of the grooves 303 and 304 of the recessed conductive members 301 and 302 forming the waveguide 300, there are cases where the waveguide 300 is not divided at the middle section of the broad wall surface 9.

In FIG. 21, the waveguide 300 of Embodiment 5 has a structure in which the conductive member 301 and the conductive member 302 are stacked while maintaining the predetermined gap 310 in a similar manner to Embodiment 4.

Due to the groove 350 being provided in a position O apart from a starting point S on the gap 310 side of the waveguide inner wall 3 by an odd number multiple of approximately ¼ the free space wavelength, the operation is of a choke structure that is open (with infinite impedance) at the end section O of the groove 350 at both ends of the waveguide and short-circuited at the starting point S on the gap 310 side of the guide wavelength inner wall 3.

Thus, it becomes possible to reduce leakage of a high-frequency signal from the gap 310 at the dividing plane 330 of the waveguide 300 to a minimum.

Incidentally, the adjacent groove 350 may be an adjacent sub-array or waveguide line.

It is also possible that the groove 350 provided to the conductive member 301 is provided to both the conductive members 301 and 302 or provided to only the conductive member 302. A similar operation is performed also in this case.

Figure 22:
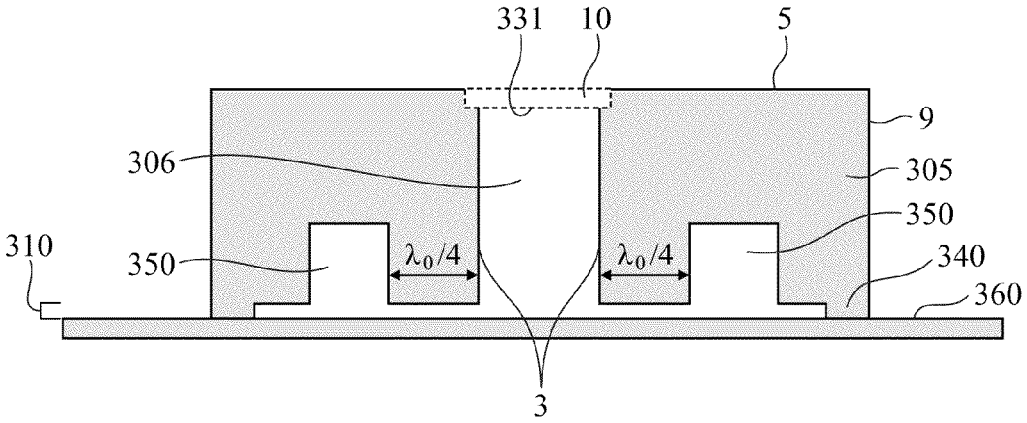
FIG. 22 is a cross sectional view showing another waveguide slot array antenna device according to Embodiment 5 of the invention.

FIG. 22 is a cross sectional view showing another waveguide slot array antenna device according to Embodiment 5.

In FIG. 22, a recessed conductive member 305 is provided with a rectangular groove 306.

A flat conductor 360 is provided in place of the conductive member 302 and arranged to oppose the conductive member 305 while maintaining the predetermined gap 310.

With a normal operation of the choke structure as shown in FIG. 21, the dividing plane 330 of the waveguide is not limited to the middle section of the broad wall surface 9, and it is possible to select any position.

For example, as shown in FIG. 22, division is possible at a surface opposing a surface at which the slot 10 of the waveguide is provided, such that a guide wall of the waveguide is shared with a flat conductor 360 of a printed substrate.

In this case, the configuration can be achieved with the single conductive member 305 forming the waveguide. Therefore, the cost for manufacturing the waveguide slot array antenna device can be reduced by about half.

As described above, according to Embodiment 5, the groove 350 is provided in the position apart from the inner wall 3 of the waveguide by an odd number multiple of approximately ¼ the free space wavelength at the usable frequency.

Therefore, even if there is a manufacturing error in the waveguide 300, the leakage of the high-frequency signal from the gap can be reduced to a minimum.

Moreover, the flat conductor 360 is arranged to oppose the conductive member 305 while maintaining the predetermined gap 310.

Therefore, the configuration can be achieved with the single conductive member 305, and the manufacturing cost can be reduced.

Embodiment 6

Figure 23:
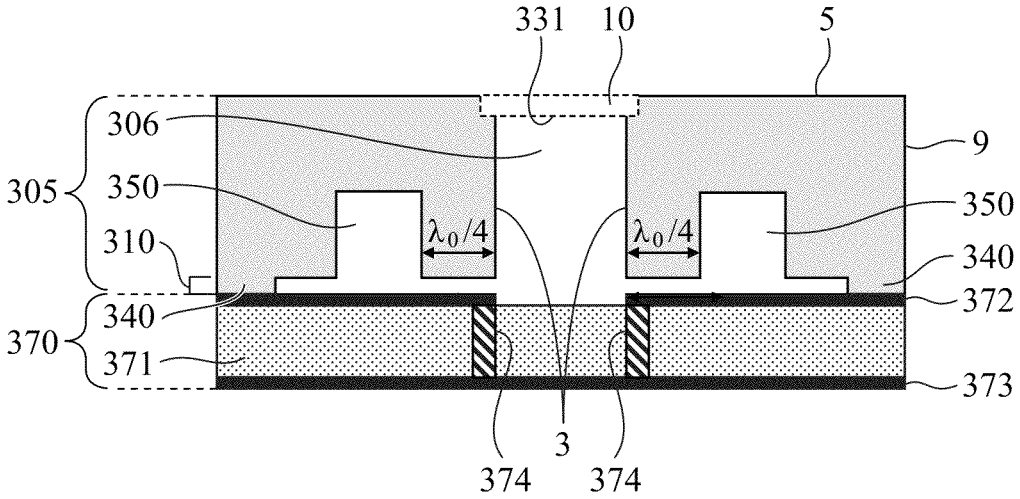
FIG. 23 is a cross sectional view showing a waveguide slot array antenna device according to Embodiment 6 of the invention.

FIG. 23 is a cross sectional view showing a waveguide slot array antenna device according to Embodiment 6.

In the waveguide slot array antenna device according to this embodiment in FIG. 23, a recessed dielectric substrate 370 is arranged to oppose the recessed conductive member 305 shown in FIG. 22 while maintaining the predetermined gap 310.

In the dielectric substrate 370, a copper foil 372 is formed on a surface of a dielectric 371 opposing the conductive member 305 except for the surface opposing a groove 306, and a copper foil 373 is formed on a back surface of the dielectric 371.

In addition, a plurality of through holes 374 that penetrate the dielectric 371 for conduction between the copper foil 372 and 373 are provided.

Thus, with the dielectric 371, the copper foil 372 and 373, and the through holes 374, a rectangular groove partially filled with the dielectric 371 is formed. Those similar to the above are denoted by the same reference numerals, and descriptions thereof will be omitted.

Next, an operation thereof will be described.

In this Embodiment 6, an operation as a waveguide is performed such that the recessed dielectric substrate 370 is opposed to the recessed conductive member 305.

In this case, the dividing plane 330 of the waveguide is determined by the thickness of the dielectric substrate 370.

Therefore, a cross sectional structure of the waveguide is a structure asymmetric with respect to the dividing plane 330 of the waveguide.

In FIG. 23, a choke structure similar to Embodiment 5 is provided to the dividing plane 330.

In this manner, a waveguide in which the loss due to leakage of a high-frequency signal from the gap 310 is suppressed and the dielectric 371 is partially filled can be obtained.

Moreover, the waveguide is easily configurable such that the dielectric 371 is partially filled within the waveguide, and the waveguide can be configured to be compact by a wavelength shortening effect in the guide wavelength of the waveguide.

As described above, according to Embodiment 6, the recessed conductive member is configured to be formed of the dielectric substrate 370 in which the rectangular groove partially filled with the dielectric 371 is formed by the dielectric 371, the copper foil 372 and 373, and the through holes 374.

Therefore, the waveguide can be downsized by the shortening effect in the guide wavelength of the waveguide due to the dielectric 371.

Embodiment 7

Figure 24:
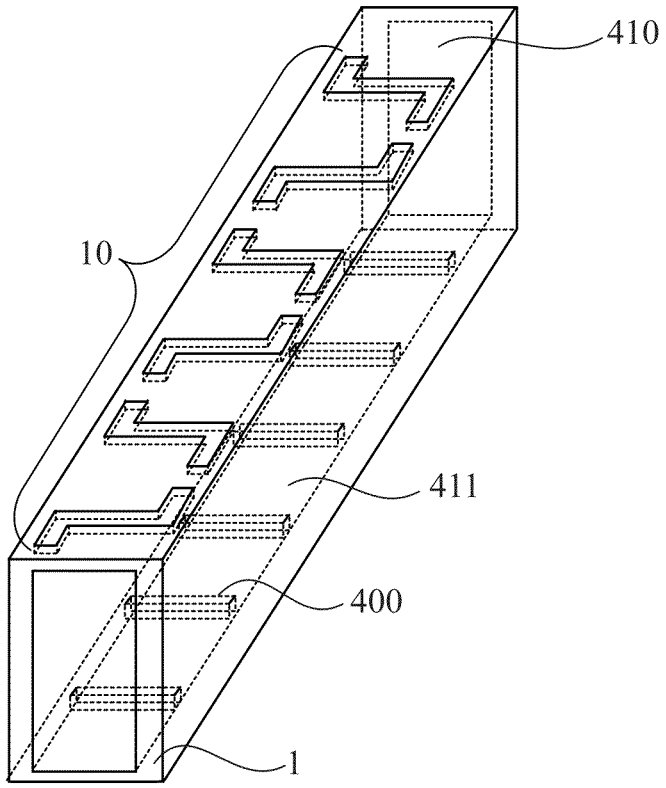
FIG. 24 is a top perspective view showing a waveguide slot array antenna device according to Embodiment 7 of the invention.

FIG. 24 is a top perspective view showing a waveguide slot array antenna device according to Embodiment 7.

Figure 25:
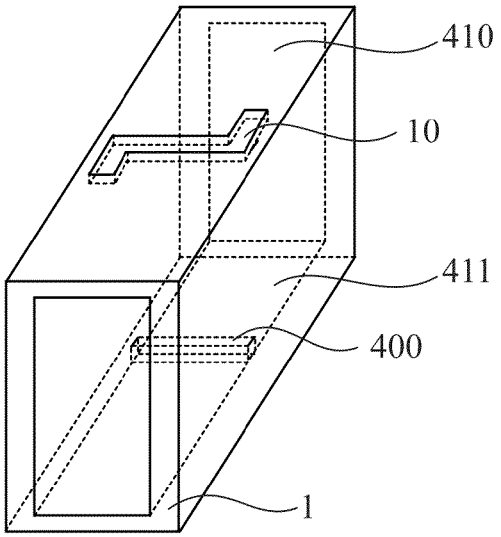
FIG. 25 is an enlarged view showing a single slot of a waveguide in FIG. 24.
Figure 26:
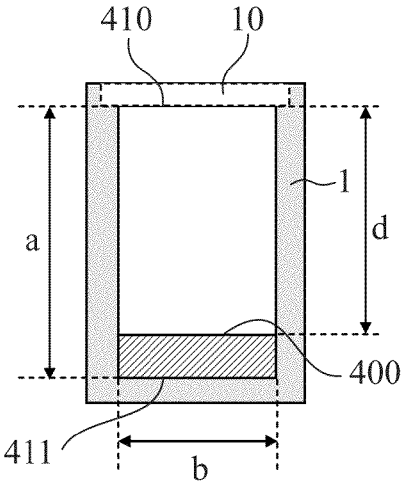
FIG. 26 is a cross sectional view of the waveguide in FIG. 25.
Figure 27:
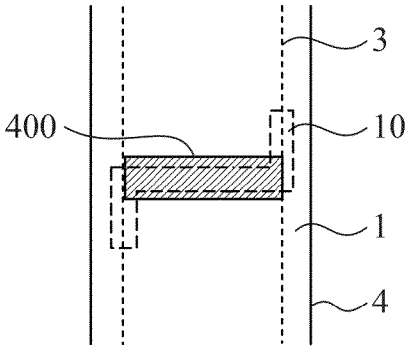
FIG. 27 is a top transparent view of FIG. 25.

FIG. 25 is a top perspective view in which a single slot in FIG. 24 is taken out, FIG. 26 is across sectional view perpendicular to a guide axis direction in FIG. 25, and FIG. 27 is a top view parallel to the guide axis direction in FIG. 25.

In the waveguide slot array antenna device according to Embodiment 7 in FIG. 24 to FIG. 27, the internal surface of the narrow wall surface forming the slot 10 of the waveguide 1 shown in FIG. 1 is denoted as a waveguide inner wall 410, and a surface opposing the waveguide inner wall 410 is denoted as a waveguide inner wall 411.

At a waveguide inner wall 411 immediately under the formed slot 10, each conductor member 400 is arranged.

One side of the conductor member 400 formed in a quadrangular prism is arranged at the waveguide inner wall 411 such that an interval of the waveguide inner walls 410 and 411 immediately under the formed slot 10 is narrowed.

In FIG. 26, a, b, and d are dimensions between waveguide inner walls: a is the dimension between the waveguide inner walls 410 and 411 of the narrow surface not immediately under the slot 10; b is the dimension between waveguide inner walls of the broad wall surface; and d is the dimension from the waveguide inner wall 410 of the narrow surface immediately under the slot 10 to the conductor member 400. Here, those similar to the above are denoted by the same reference numerals, and descriptions thereof will be omitted.

Next, an operation thereof will be described.

In FIG. 26, when the dimension d between waveguide inner walls immediately under the slot 10 is narrowed with respect to the dimension a between waveguide inner walls not immediately under the slot 10, a magnetic field is concentrated between the waveguide inner wall 410 immediately under the slot 10 and the conductor member 400 arranged at the waveguide inner wall 411 opposing the waveguide inner wall 410.

Therefore, the inductivity of a slot section is larger as the dimension d between waveguide inner walls immediately under the slot 10 is narrower.

Accordingly, it is possible to adjust the reactance component of the slot section at will.

Figure 28:
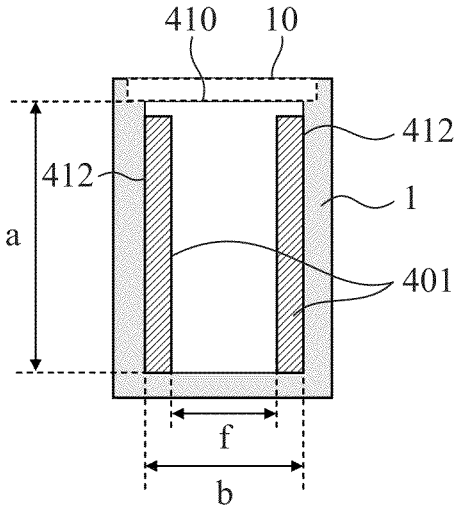
FIG. 28 is a cross sectional view showing another waveguide slot array antenna device according to Embodiment 7 of the invention.
Figure 29:
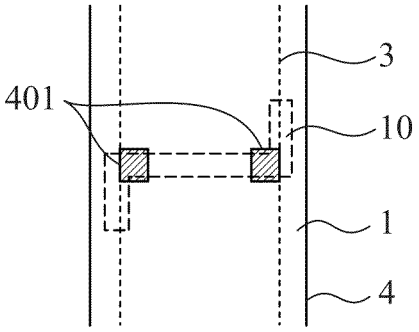
FIG. 29 is a top transparent view of a slot in FIG. 28.

FIG. 28 is a cross sectional view showing another waveguide slot array antenna device according to Embodiment 7, and FIG. 29 is a top view of FIG. 28.

In FIG. 28 and FIG. 29, the internal surface of the broad wall surface of the waveguide 1 shown in FIG. 1 is denoted as a waveguide inner wall 412, and each conductor member 401 is arranged at the waveguide inner wall 412 immediately under the formed slot 10.

One side of the conductor member 401 formed in a quadrangular prism is arranged at the waveguide inner wall 412 such that the interval of the waveguide inner walls 412 immediately under the formed slot 10 is narrowed.

In FIG. 28, f is the dimension between waveguide inner walls that is the dimension between the conductor members 401 arranged at the waveguide inner wall 412 of the broad wall surface immediately under the slot 10. Here, those similar to the above are denoted by the same reference numerals, and descriptions thereof will be omitted.

Next, an operation thereof will be described.

When the dimension f between waveguide inner walls immediately under the slot 10 is narrowed with respect to the dimension b between waveguide inner walls not immediately under the slot 10 in FIG. 28 and FIG. 29, an electric field is concentrated between the conductor members 401 arranged together with the waveguide inner wall 412 adjacent to the waveguide inner wall 410 immediately under the slot 10.

Therefore, the capacity of a slot section is larger as the dimension f between waveguide inner walls immediately under the slot 10 is narrower.

Accordingly, it is possible to adjust the reactance component of the slot section at will.

Figure 30:
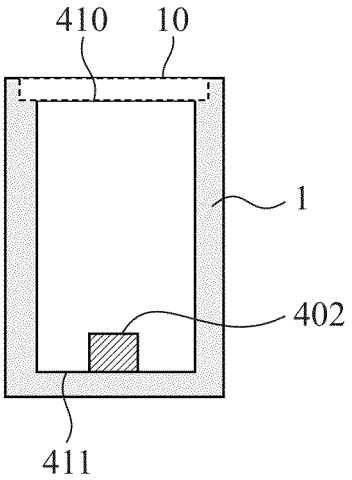
FIG. 30 is a cross sectional view showing another waveguide slot array antenna device according to Embodiment 7 of the invention.
Figure 31:
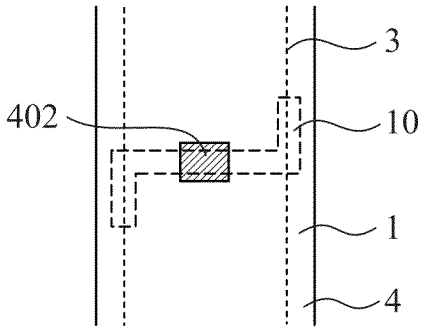
FIG. 31 is a top transparent view of a slot in FIG. 30.

FIG. 30 is a cross sectional view showing another waveguide slot array antenna device according to Embodiment 7, and FIG. 31 is a top view of FIG. 30.

In FIG. 30 and FIG. 31, each conductor member 402 is arranged at the waveguide inner wall 411 immediately under the formed slot 10.

The bottom surface of the conductor member 402 formed in a quadrangular prism is arranged at a part of the waveguide inner wall 411 such that the interval of the waveguide inner walls 410 and 411 immediately under the formed slot 10 is narrowed. Here, those similar to the above are denoted by the same reference numerals, and descriptions thereof will be omitted.

Figure 32:
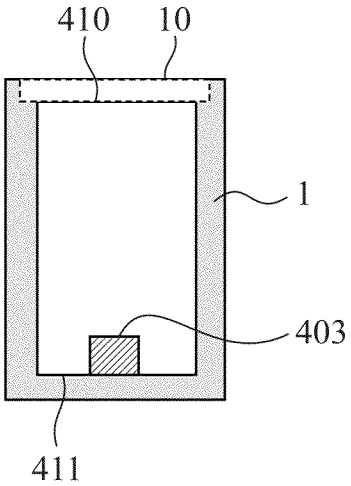
FIG. 32 is a cross sectional view showing another waveguide slot array antenna device according to Embodiment 7 of the invention.
Figure 33:
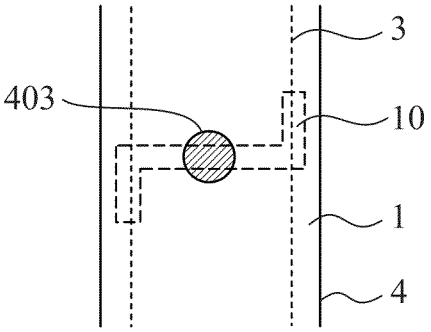
FIG. 33 is a top transparent view of a slot in FIG. 32.

FIG. 32 is a cross sectional view showing another waveguide slot array antenna device according to Embodiment 7, and FIG. 33 is a top view of FIG. 32.

In FIG. 32 and FIG. 33, each conductor member 403 is arranged at the waveguide inner wall 411 immediately under the formed slot 10.

The bottom surface of the conductor member 403 formed in a cylinder is arranged at a part of the waveguide inner wall 411 such that the interval of the waveguide inner walls 410 and 411 immediately under the formed slot 10 is narrowed. Here, those similar to the above are denoted by the same reference numerals, and descriptions thereof will be omitted.

Figure 34:
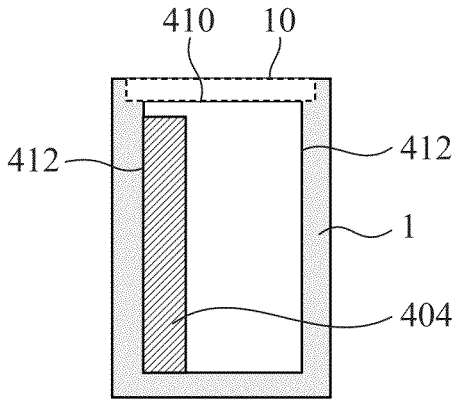
FIG. 34 is a cross sectional view showing another waveguide slot array antenna device according to Embodiment 7 of the invention.
Figure 35:
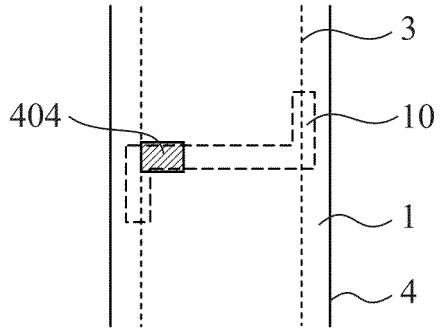
FIG. 35 is a top transparent view of a slot in FIG. 34.

FIG. 34 is a cross sectional view showing another waveguide slot array antenna device according to Embodiment 7, and FIG. 35 is a top view of FIG. 34.

In FIG. 34 and FIG. 35, each conductor member 404 is arranged at one waveguide inner wall 412 immediately under the formed slot 10.

One side of the conductor member 404 formed in a quadrangular prism is arranged at the waveguide inner wall 412 such that the interval of the waveguide inner walls 412 immediately under the formed slot 10 is narrowed. Here, those similar to the above are denoted by the same reference numerals, and descriptions thereof will be omitted.

Figure 36:
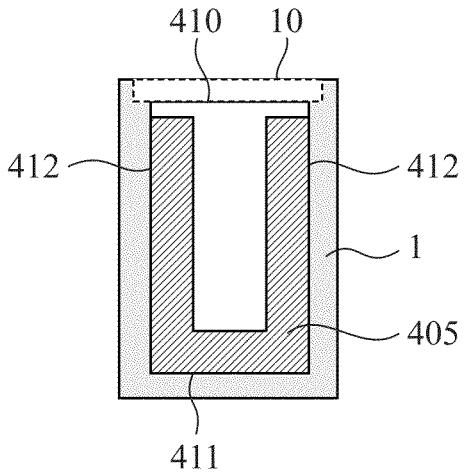
FIG. 36 is a cross sectional view showing another waveguide slot array antenna device according to Embodiment 7 of the invention.
Figure 37:
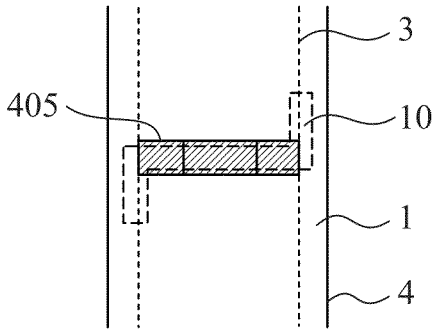
FIG. 37 is a top transparent view of a slot in FIG. 36.

FIG. 36 is a cross sectional view showing another waveguide slot array antenna device according to Embodiment 7, and FIG. 37 is a top view of FIG. 36.

In FIG. 36 and FIG. 37, each conductor member 405 is arranged at the waveguide inner walls 411 and 412 immediately under the formed slot 10.

One side of the conductor member 405 formed in a quadrangular prism is arranged at the waveguide inner walls 411 and 412 such that the interval of the waveguide inner walls 410 and 411 and the interval of the waveguide inner walls 412 immediately under the formed slot 10 are narrowed. Here, those similar to the above are denoted by the same reference numerals, and descriptions thereof will be omitted.

Figure 38:
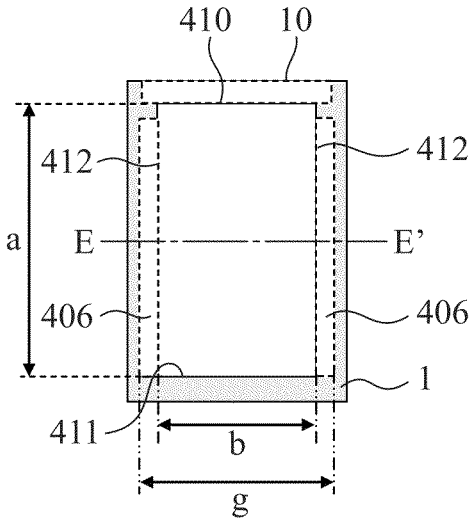
FIG. 38 is a cross sectional view showing another waveguide slot array antenna device according to Embodiment 7 of the invention.
Figure 39:
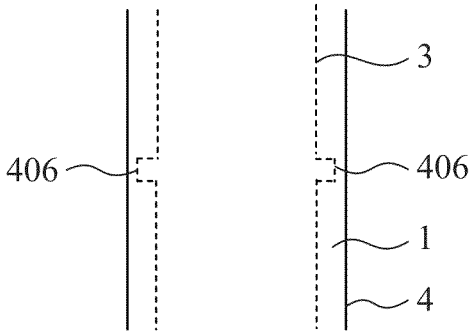
FIG. 39 is across sectional view showing an E-E' cross section in FIG. 38.

FIG. 38 is a cross sectional view showing another waveguide slot array antenna device according to Embodiment 7, and FIG. 39 is an E-E' cross section in FIG. 38.

In FIG. 38 and FIG. 39, each recessed section 406 is formed at the waveguide inner wall 412 immediately under the formed slot 10.

The recessed section 406 is a cutout in the waveguide inner wall 412 such that the interval of the waveguide inner walls 412 immediately under the formed slot 10 is broadened.

In FIG. 38, g is the dimension between waveguide inner walls that is the dimension between the waveguide inner walls 412 in consideration of the recessed section 406 of the broad wall surface immediately under the slot 10. Here, those similar to the above are denoted by the same reference numerals, and descriptions thereof will be omitted.

Incidentally, the recessed section 406 is a cutout in the waveguide inner wall 412 such that the interval of the waveguide inner walls 412 immediately under the formed slot 10 is broadened in FIG. 38 and FIG. 39, but it may be a cutout in the waveguide inner wall 411 such that the interval of the waveguide inner walls 410 and 411 immediately under the formed slot 10 is broadened.

Figure 40:
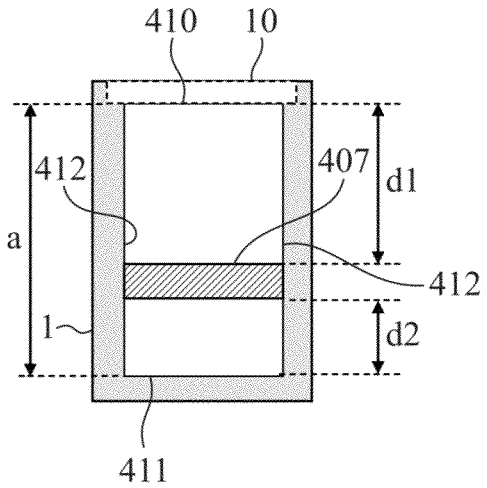
FIG. 40 is a cross sectional view showing another waveguide slot array antenna device according to Embodiment 7 of the invention.
Figure 41:
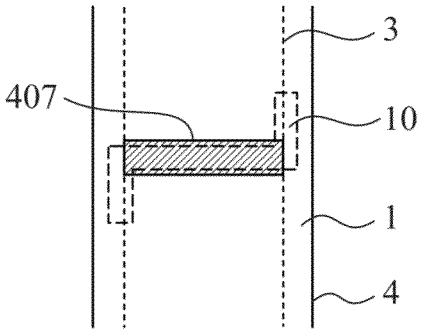
FIG. 41 is a top transparent view of a slot in FIG. 40.
Figure 42:
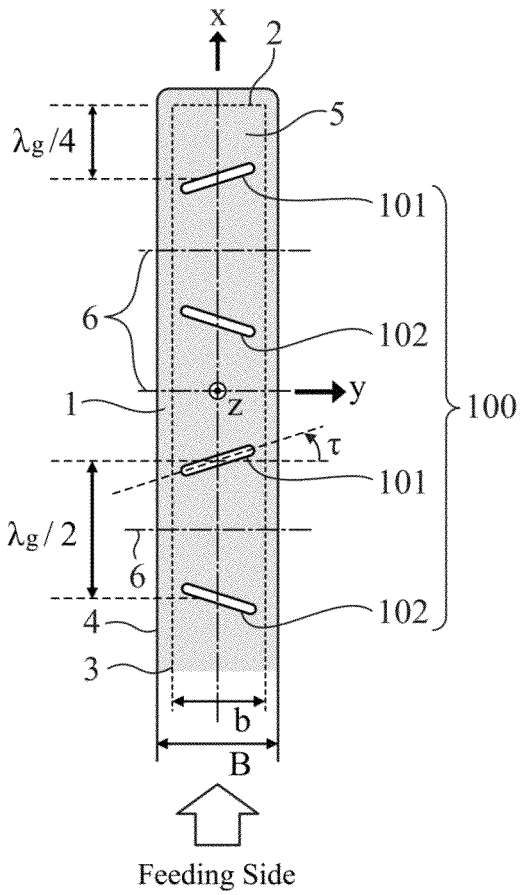
FIG. 42 is a top view showing a waveguide slot array antenna device of Conventional Example 1.

FIG. 40 is a cross sectional view showing another waveguide slot array antenna device according to Embodiment 7, and FIG. 41 is a top view of FIG. 40.

In FIG. 40 and FIG. 41, each conductor member 407 is arranged between the waveguide inner wall 410 and the waveguide inner wall 411 immediately under the formed slot 10.

Both bottom surfaces of the conductor member 407 formed in a quadrangular prism are arranged at the waveguide inner wall 412 such that the interval of the waveguide inner walls 410 and 411 immediately under the formed slot 10 is narrowed.

In FIG. 40, d1 and d2 are dimensions between waveguide inner walls: d1 is the dimension from the waveguide inner wall 410 of the narrow wall surface immediately under the slot 10 to the conductor member 407; and d2 is the dimension from the conductor member 407 to the waveguide inner wall 411 of the narrow wall surface immediately under the slot 10.

Since the dimension d1+d2 between waveguide inner walls is smaller than the dimension d between waveguide inner walls, the interval of the waveguide inner walls 410 and 411 immediately under the formed slot 10 can be narrowed. Here, those similar to the above are denoted by the same reference numerals, and descriptions thereof will be omitted.

The examples of the shape of the conductor member for changing the dimension between waveguide inner walls are shown in FIG. 24 to FIG. 2, not limited to these, and as shown in FIG. 30 to FIG. 33, the shape of the conductor member may be configured such that only the part of the waveguide inner wall is extended.

In addition, as shown in FIG. 34 to FIG. 37, the conductor member for changing the dimension between waveguide inner walls may be provided to at least one waveguide inner wall out of the waveguide inner wall opposing the waveguide inner wall at which the slot is formed and the waveguide inner wall adjacent to the waveguide inner wall at which the slot is formed.

Further, the structure for changing the dimension between waveguide inner walls may be a structure in which the waveguide inner wall is recessed to broaden the dimension between waveguide inner walls immediately under the slot as shown in FIG. 38 and FIG. 39 or a structure provided with a conductor member in a space between waveguide inner walls immediately under the slot as shown in FIG. 40 and FIG. 41.

In this case also, it is possible to adjust the reactance component of the slot section at will.

As described above, according to Embodiment 7, the dimension between waveguide inner walls between the broad wall surfaces or between the narrow wall surfaces immediately under the formed slot 10 is configured to be different from the dimension between waveguide inner walls not immediately under the slot 10.

Therefore, by adjusting the dimension between waveguide inner walls between the broad wall surfaces or between the narrow wall surfaces immediately under the slot 10, the reactance component of the slot section can be adjusted at will.

It is noted that in the present invention, a free combination in the embodiments, a modification of arbitrary components in the embodiments, or an omission of arbitrary components in the embodiments is possible within a range of the invention.

INDUSTRIAL APPLICABILITY

In the present invention, when the direction orthogonal to the guide axis at the surface of the waveguide at which the slot is provided is denoted as the waveguide width direction, the middle section of the slot is placed in the waveguide width direction, and at least one of the tip sections of the slot has the shape extending along the guide axis direction of the waveguide, and part of the tip section of the slot extending along the guide axis direction is configured to overlap with the inner wall of the waveguide when seen from the normal direction of the surface of the waveguide at which the slot is provided, and thus the invention is suitable for a waveguide slot array antenna device formed with a slot at at least one wall surface of a waveguide.

DESCRIPTION OF REFERENCE NUMERALS

1, 300: Waveguides, 2: Short-circuit surface, 3, 7, 410 to 412: Waveguide inner walls, 4, 8: Waveguide outer walls, 5: Narrow wall surface, 6: Center line, 9: Broad wall surface, 10 to 12, 30 to 32, 40 to 42, 50 to 52, 60 to 62, 70 to 72, 80 to 82, 90, 91: Slots, 13, 33: Middle sections, 14, 15, 34, 35: Bent end sections, 21: Admittance, 301, 302, 305: Conductive members, 303, 304, 306, 350: Grooves, 310: Gap, 330: Dividing plane, 331: Bottom surface, 340: Protruding section, 341: Spacer, 360: Flat conductor, 370: Dielectric substrate, 371:

Dielectrics, 372, 373; Copper foils, 374: Through hole, 400 to 405, 407: Conductor members, 406: Recessed section.

The invention claimed is:

1. A waveguide slot array antenna device formed with a slot at at least one wall surface of a waveguide with a rectangular cross section, wherein when a direction orthogonal to a guide axis at a surface of the waveguide at which the slot is provided is denoted as a waveguide width direction, a middle section of the slot is placed in the waveguide width direction, and at least one of tip sections of the slot has a shape extending along a guide axis direction of the waveguide, and wherein a part of the tip section of the slot extending along the guide axis direction is configured to overlap with an inner wall of the waveguide when seen from a normal direction of the surface of the waveguide at which the slot is provided.

2. The waveguide slot array antenna device according to claim 1, wherein at least one of the tip sections of the slot has the shape extending along the guide axis direction of the waveguide, and the middle section of the slot and the tip section of the slot is formed to be at a right angle.

3. A waveguide slot array antenna device formed with a slot at at least one wall surface of a waveguide with a rectangular cross section, wherein when a direction orthogonal to a guide axis at a surface of the waveguide at which the slot is provided is denoted as a waveguide width direction, a middle section of the slot is placed to be inclined by a predetermined angle with respect to the waveguide width direction, and at least one of tip sections of the slot has a shape extending along a guide axis direction of the waveguide, and wherein a part of the tip section of the slot extending along the guide axis direction is configured to overlap with an inner wall of the waveguide when seen from a normal direction of the surface of the waveguide at which the slot is provided.

4. The waveguide slot array antenna device according to claim 3, wherein at least one of the tip sections of the slot has the shape extending along the guide axis direction of the waveguide, and the middle section of the slot and the tip section of the slot is formed to be at an acute angle.

5. The waveguide slot array antenna device according to claim 3, wherein at least one of the tip sections of the slot has the shape extending along the guide axis direction of the waveguide, and the middle section of the slot and the tip section of the slot is formed to be at an obtuse angle.

6. The waveguide slot array antenna device according to claim 3, wherein both of the tip sections of the slot have a shape extending along the guide axis direction of the waveguide, and the middle section of the slot is curved and formed in an S shape.

7. The waveguide slot array antenna device according to claim 1, wherein the waveguide is a ridge waveguide provided with a ridge.

8. The waveguide slot array antenna device according to claim 1, wherein the waveguide is a coaxial waveguide that is a coaxial line.

9. The waveguide slot array antenna device according to claim 1, wherein the waveguide is a dielectric-filled waveguide filled with dielectric in at least a part of a waveguide interior.

10. A waveguide slot array antenna device, wherein a waveguide slot array antenna device according to claim 1 is used as one sub-array, and an array antenna is configured by arranging a plurality of the sub-arrays.

11. The waveguide slot array antenna device according to claim 1, wherein the waveguide is configured such that two recessed members each provided with a first rectangular groove are opposed with a predetermined interval in between.

12. The waveguide slot array antenna device according to claim 11, wherein at least one recessed member out of the two recessed members is provided with a second groove in a position apart from an inner wall of the first groove of the recessed member by an odd number multiple of ¼ a free space wavelength at a usable frequency.

13. The waveguide slot array antenna device according to claim 1, wherein the waveguide is configured such that a recessed member provided with a first rectangular groove and provided with a second groove in a position apart from an inner wall of the first groove by an odd number multiple of ¼ a free space wavelength at a usable frequency, and a flat conductor are opposed with a predetermined interval in between.

14. The waveguide slot array antenna device to claim 1, wherein, when a dimension from a first inner wall of one wall surface of the waveguide at which the slot is formed to a second inner wall opposing the first inner wall is denoted as a dimension between waveguide inner walls, the dimension between waveguide inner walls immediately under the formed slot is configured to be different from the dimension between waveguide inner walls not immediately under the formed slot.

15. The waveguide slot array antenna device to claim 1, wherein, when a dimension from a third inner wall of a wall surface adjacent to one wall surface of the waveguide at which the slot is formed to a fourth inner wall opposing the third inner wall is denoted as a dimension between waveguide inner walls, the dimension between waveguide inner walls immediately under the formed slot is configured to be different from the dimension between waveguide inner walls not immediately under the formed slot.

* * * * *